United States Patent [19]

Dombroski et al.

[11] Patent Number: 4,598,839

[45] Date of Patent: Jul. 8, 1986

[54] TAMPER EVIDENT SQUEEZE TUBE

[75] Inventors: Edward Dombroski, Sea Girt; Richard W. Potts, North Caldwell, both of N.J.

[73] Assignee: Peerless Tube Company, Bloomfield, N.J.

[21] Appl. No.: 495,526

[22] Filed: May 17, 1983

Related U.S. Application Data

[63] Continuation-in-part of Ser. No. 462,929, Feb. 1, 1983, Pat. No. D. 281,055.

[51] Int. Cl.[4] ..... B65D 35/00

[52] U.S. Cl. ..... 222/92; 222/106; 222/153; 222/541; 215/211; 220/258

[58] Field of Search ..... 215/204, 211, 222, 250; 220/258, 270; 222/92, 106, 107, 153, 213, 215, 491, 494, 541

[56] References Cited

U.S. PATENT DOCUMENTS

| | | | |
|---|---|---|---|
| 801,227 | 10/1905 | Drummond | 222/541 X |
| 2,169,173 | 8/1939 | Westin | 222/541 |
| 2,808,926 | 10/1957 | Drake et al. | 222/107 X |
| 3,083,916 | 4/1963 | Neel | 222/541 X |
| 3,278,089 | 10/1966 | Heekin et al. | 222/541 X |
| 4,157,765 | 6/1979 | Golebiewsky | 220/258 X |

FOREIGN PATENT DOCUMENTS

| | | | |
|---|---|---|---|
| 257496 | 9/1926 | United Kingdom | 220/258 |

*Primary Examiner*—Joseph J. Rolla
*Assistant Examiner*—David H. Bollinger
*Attorney, Agent, or Firm*—Edward R. Weingram

[57] ABSTRACT

A tamper evident squeeze tube is provided which comprises an elongated tube having flexible walls which is sealed at one end. An end cap is provided at the other end which comprises a neck having an opening therein to the interior of the tube and a frangible sealing member mounted across the opening for sealing the opening and indicating tampering with the contents therein. A coacting cap is provided which is adapted to mount to the exterior of the neck. Preferably, the sealing member is a flexible dome shaped member which is frangibly and integrally connected to the neck and has a tab attached to the exterior of the dome for removing the sealing member.

8 Claims, 9 Drawing Figures

TAMPER EVIDENT SQUEEZE TUBE

RELATED APPLICATION

This is a continuation-in-part of Design Patent Application Ser. No. 462,929 filed on Feb. 1, 1983 now U.S. Pat. No. D281055.

BACKGROUND OF THE INVENTION

1. Field of the Invention

This invention relates to tamper evident packaging, and in particular squeeze tubes or collapsible tubes, such as those used for packaging toothpaste, and to the provision for a sealing means which clearly indicates if the tube has been tampered with.

2. Description of the Prior Art

Of recent date, it has been quite evident that there is a need for new sealing means for packaging to prevent undetected tampering with the contents thereof, either through the inadvertent opening of the package or through the intentional tampering and introduction of foreign materials, e.g. poisons into the package. Manufacturers of food and over-the-counter drugs are particularly concerned with sealing packages to prevent such tamperings. One aspect of the over-the-counter market is squeeze tube or collapsible tube packaging, for example for toothpastes, ointments, etc.

Collapsible tubes may be formed of a metal, e.g. aluminum, and have a separate neck thereon formed of a synthethic plastic such as polyethylene. Typically, the metallic tube has an integral neck through which the contents of the tube are discharged and the plastic neck in the form of a fitment is mechanically applied to the exterior of the metal neck so as to cover or sheath the exterior periphery and the end surface of the metal neck, see for example U.S. Pat. Nos. 3,124,273 to Remington et al and 3,073,485 to Schultz.

Such tubes may also be made by extruding a hollow elongated tube having flexible walls and integrally forming a head thereon. The head typically has a shoulder portion and a threaded dispensing neck for mounting a cap thereon. The tube is generally filled through the rear and sealed while the cap is on the neck.

Efforts to prevent tampering with the contents of squeeze tube range from none, as in the case of most present, toothpaste tubes to the relatively heavy or thick sealing closures integrally formed at the opening of the tube neck. These metal closures are less than satisfactory because they are relatively difficult to pierce, often requiring a separate implement, such as a nail or tine of a fork, and once pierced often causes shards of metal to be mixed with the contents of the tube. Also, the puncturing process is frequently difficult to accomplish neatly without causing a discharge of the tube's contents from the end of the tube.

Thus, it can be seen that it is desirable that any tamper evident seal for a squeeze tube should be easily removable so that the contents thereof and the neck of the tube remain sanitary. It is also highly desirable that any sealing means applied to the neck of the tube be capable of being physically tested to determine whether the seal has been tampered with, even if close observation reveals it has not been tampered with.

SUMMARY OF THE INVENTION

It is an object of the present invention to eliminate some of the short comings of the prior art squeeze tubes. This invention provides a tamper evident squeeze tube which comprises a hollow elongated tube having flexible walls. A sealing means is provided at one end and a dispensing head at the other end. The dispensing head comprises a neck having an opening therein to the interior of the tube and a sealing member frangibly mounted across the opening for sealing the opening and indicating tampering with the contents therein. A tube cap is provided which is adapted to be mounted to the exterior of the neck and coact with the sealing member and dispensing head to prevent the fracturing of the sealing member during filling. Preferably, the sealing member is a flexible dome-shaped member which is integral with the neck and frangibly attached thereto and has a tab means attached to the exterior of the dome for removing the member. The squeeze tube with sealing member may be made in one continuous operation. Optionally, the dispensing head comprises a fitment applied to the exterior of the neck of the squeeze tube. The exterior of the fitment has a means for mounting the tube cap thereon and an interior opening in the fitment which sheaths the neck of the tube. The sealing member is frangibly mounted across the opening of the fitment. When the sealing member has been tampered with it can be readily detected for the member will be fractured from the neck of the end cap. The sealing member can be easily and sanitarily removed by grasping the tab attached thereto. Still further, the integrity of the sealing member may be physically tested by squeezing the tube. If the dome cracks and/or "pops" our or off the neck of the dispensing head, the tube has not been tampered with.

It is thus an object of this invention to provide a tamper evident squeeze tube.

It is a further object of this invention to provide a tamper evident squeeze tube which can be made in a single extrusion process step.

It is still a further object of this invention to provide a tamper evident squeeze tube which can be easily filled.

It is yet another object of this invention to provide a tamper evident squeeze tube which can be tested to determine whether the contents of the tube have been tampered with.

It is still a further object of this invention to provide a tamper evident squeeze tube which is comparatively inexpensive to manufacture and use and is simple in construction.

It is a further object of this invention to provide a tamper evident squeeze tube having a filling cap which coacts with the sealing member and dispensing head to prevent the fracturing of the sealing member from the dispensing head during filling.

It is yet another object of this invention to provide a tamper evident sealing member for the neck of a squeeze tube which may be easily and sanitarily removed.

It is still a further object of this invention to provide a tamper evident sealing member for a squeeze tube which readily evidences the fact of tampering with the contents of the tube.

These and other objects and advantages will become apparent from the following description taken in conjunction with the accompanying drawings.

DETAILED DESCRIPTION OF THE INVENTION

Figure 1:
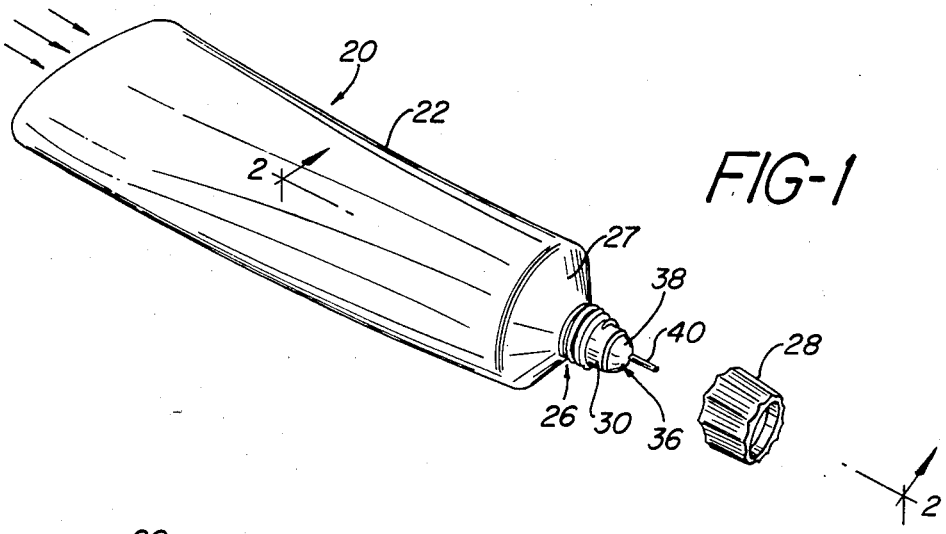
FIG. 1 is a perspective view of one embodiment of the tamper evident squeeze tube prior to filling the squeeze tube and prior to mounting the tube cap thereon.

Referring now to FIGS. 1 through 8, the tamper evident squeeze tube of this invention is generally designated 20. The squeeze tube 20 is comprised of a hollow elongated tube 22 having a sealing means at one end 24 (see FIG. 4). Typically, the tube 22 may be made of any synthetic plastic composition which may be a thermoplastic or thermosetting material, e.g. polyethylene, or any other well-known materials for making such tubes which has resiliency and elasticity, e.g. aluminum. The means for forming the tube 22, filling and sealing the end 24 thereof are well-known procedures in the art. On the other end of tube 22 is a dispensing head, generally designated 26, which typically, and preferably, is integrally formed with tube 22 and projects from frustoconical shoulder 27. A tube cap 28, 728, and 828 is provided (see FIGS. 1–3, 7, and 8) which is adapted to be threadedly mounted to the exterior of neck 30. The neck 30 has an opening 32 therein (see FIGS. 2, 3, and 6–8) to the interior 34 of tube 22.

Figure 6:
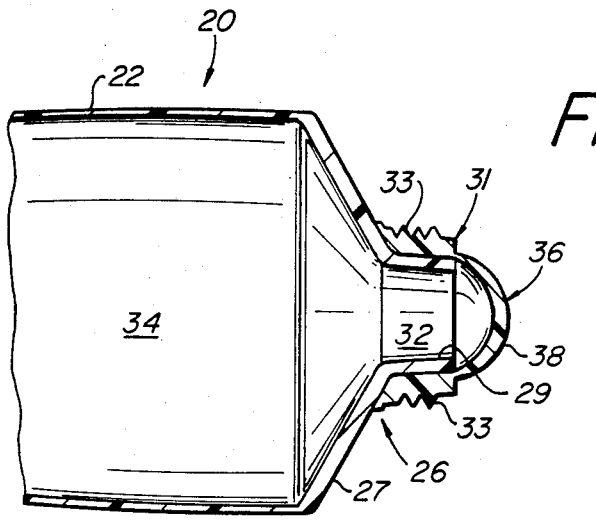
FIG. 6 is a cross-sectional view of another embodiment of the dispensing head and sealing member which may be used with the tamper evident tube of this invention.

Referring to FIG. 6, a fitment, generally designated 31 is provided which mechanically mounts to neck 29 of tube 22 and abuts shoulder 27. This fitment 31 includes threads 33 on the exterior thereof to which the tube cap may be mounted. The interior opening of the fitment 31 is adapted to frictionally fit (as shown in FIG. 6) or mechanically interlock (not shown) with neck 29 and thereby sheath the neck 29.

An essential element of this invention is the frangible sealing member, generally designated 36 which is mounted across opening 32 for sealing the opening 32 and indicating tampering with the contents within the tube 22.

A preferred embodiment of the sealing member 36 and coacting tube cap 28 is depicted in FIGS. 1–5B. In this embodiment, the sealing member 36 is integral with the neck 30 and is simultaneously formed therewith in one process step, preferably from a polyethylene, polypropylene, etc. or other polymeric material. Typically, this is accomplished through an extrusion process. This preferred sealing member 36 is a dome 38 which has attached to the exterior thereof a tab means which is an elongated member 40 projecting from the center of dome 38. The dome 38 is preferably flexible to permit flexing of the frangible joint between neck 30 and dome 38 to permit dome 38 to flex inwardly into opening 32 when coacting cap 28 is placed thereon.

Figure 2:
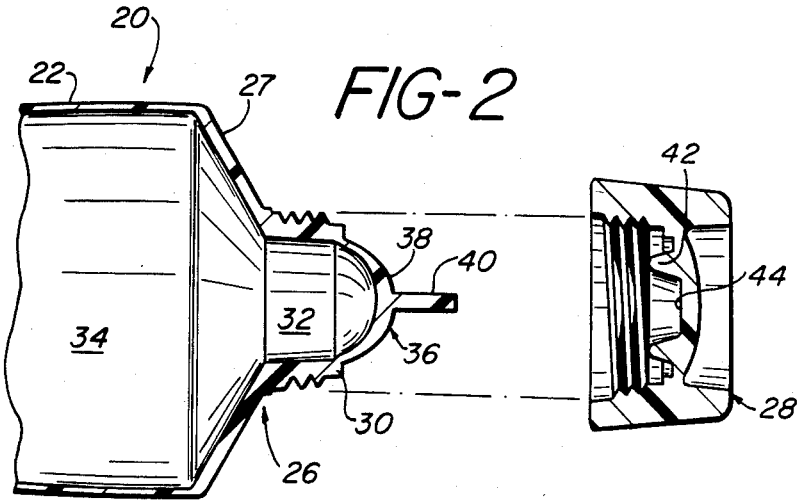
FIG. 2 is a cross-sectional view of the tube of FIG. 1 taken along line 2—2.
Figure 3:
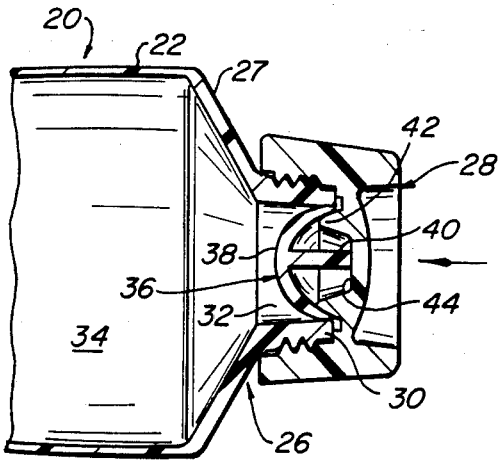
FIG. 3 is a cross-sectional view of the squeeze tube of FIGS. 1 and 2 after the cap has been placed thereon.
Figure 4:
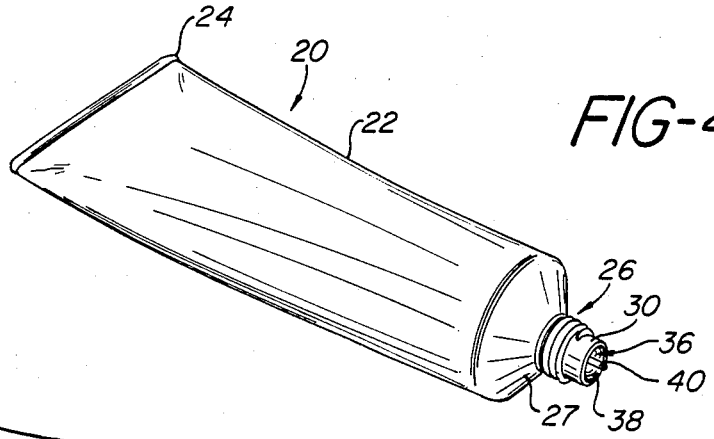
FIG. 4 is a perspective view of the tamper-evident squeeze tube of FIGS. 1–3, after the tube has been filled and the cap has been removed.

As indicated in FIGS. 2 and 3, coacting cap 28 has in the interior thereof a means for coacting and forcing dome 38 into opening 32 while cap 28 is being mounted to neck 30 by the threadable engagement of cap 28 to neck 30. This means comprises a lip 42 on the interior of cap 28 which is adapted to force the circumferential area of dome 38 into opening 32 without breaking the frangible seal between neck 30 and dome 38. The cap further includes a planar surface 44 on the central interior portion of cap 28 which is adapted to force tab 40, which projects from the center of dome 38, into opening 32 to thereby assist in forcing dome 38 into opening 32. After the cap 28 is placed on the tube, as indicated in FIG. 3, the tube is filled from the rear thereof (see FIG. 1—arrows) and sealed (FIGS. 4, 24). The cap 28, during the filling of tube 22, coacts with dome 38, to prevent the fracturing of the dome 38 from the neck 30 and maintains the dome 38 (in this embodiment) in the depressed position inside neck 30.

Thus, when the consumer removes cap 28 from neck 30, if he does not see elongated member 40 in the position depicted in FIG. 4 with the dome 38 unfractured from neck 30, he can assume that the tube has been tampered with. Still further, assuming that tab 40 and dome 38 visually appear to be in the position depicted in FIG. 4 and dome 38 visually appears unfractured from neck 30, the user may readily test the tube to determine whether it has been tampered with by squeezing it (see FIG. 5A). The squeezing of the tube, if the sealing means has not been tampered with, will cause dome 38 to "pop" outwardly and/or crack off causing the elongated member to project outwardly and beyond neck 30. If the tube was tampered with, dome 38 would not "pop" out and the material inside the tube would squeeze around or through the cracks in the dome caused by the tampering.

Figure 5A:
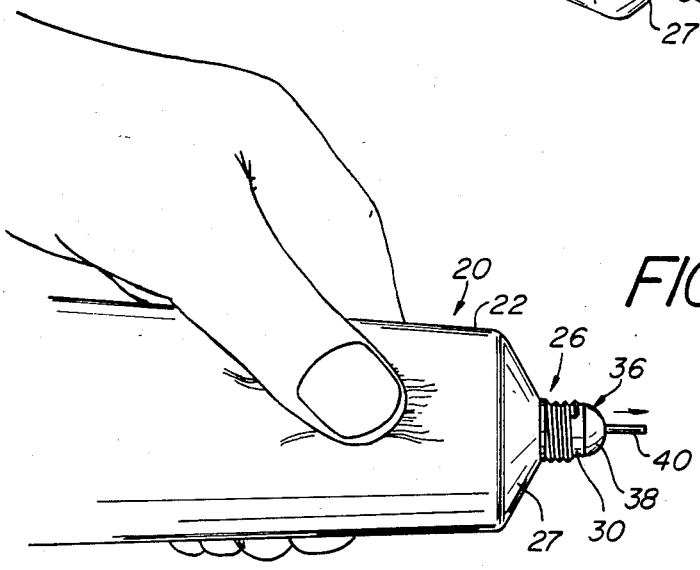
FIG. 5A is a perspective view of the squeeze tube of FIGS. 1–4 being tested for tampering.
Figure 5B:
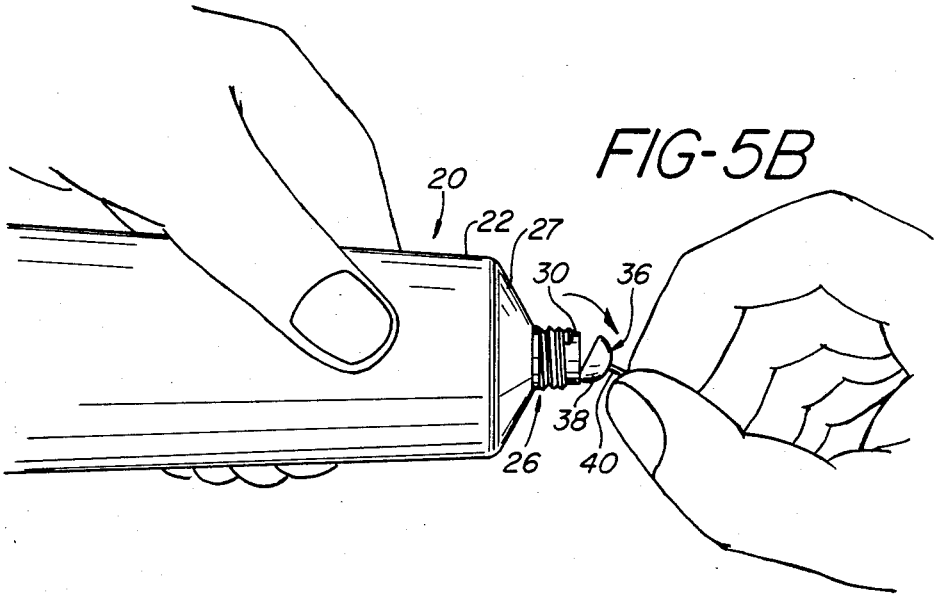
FIG. 5B is a perspective view of the squeeze tube of FIG. 5A having the sealing member fractured and removed from the tube after being tested for tampering.

If the sealing member 36 has not been tampered with the consumer may easily and sanitarily remove the sealing member by merely twisting tab 40 and fracturing the frangible seal around and between dome 38 and neck 30 providing access to the contents thereof (see FIG. 5B).

Figure 7:
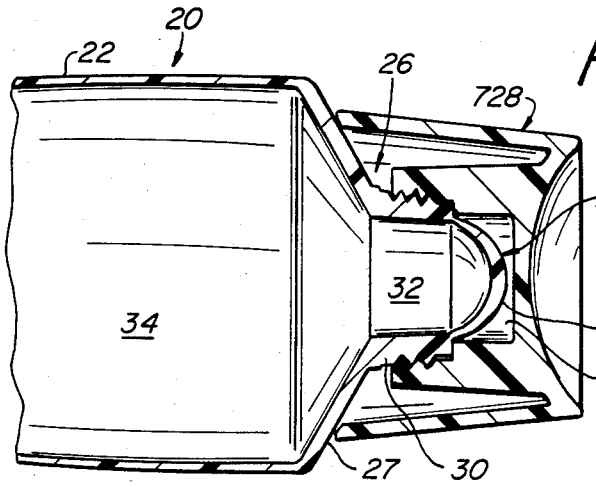
FIGS. 7 and 8 are cross-sectional views of two embodiments of tube caps which coact with the sealing member during filling and may be utilized with the embodiment of the sealing member depicted in FIG. 6.
Figure 8:
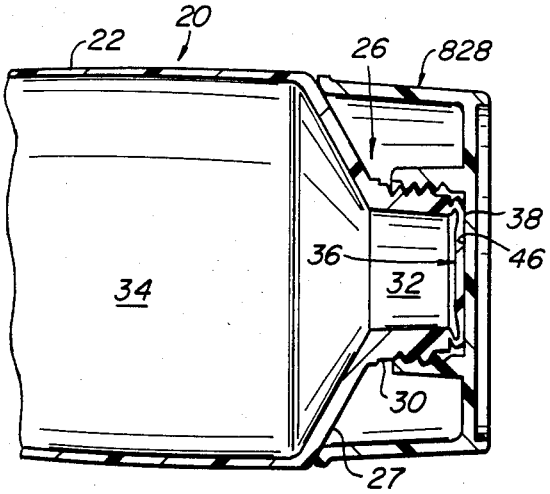

Another embodiment of the sealing member 36 is depicted in FIGS. 6–8 which depicts a sealing member which does not have a tab attached to dome 38. This type of sealing member may have two types of caps mounted thereon as depicted in FIGS. 7 and 8.

FIG. 7 depicts cap 728 utilized in conjunction with the dome 38. This cap includes a chamber 48 for enclosing the dome when cap 728 is mounted on neck 30, such a cap coacts with dome 38 and neck 30 to prevent the dome 38 from fracturing from neck 30 during the filling of the tube. Additionally, the consumer when he removes cap 728 notices that dome 38 is in a perfect spherical shape and, if not, the tube has probably been tampered with. Upon squeezing the tube, dome 38 should crack and/or "pop" off neck 30 indicating that the contents thereof have not been tampered with.

In FIG. 8, the interior of cap 828 includes a planar surface 46 which collapses dome 38 flush with the top of neck 30 without fracturing the frangible seal between the dome 38 and neck 30 when the cap is mounted on the neck. Such a cap also coacts with the neck and dome during filling to prevent fracturing of the dome. Thus, the consumer, when he removes cap 828 there-from, will note that the dome is crushed, however, upon squeezing the tube 22, the dome 38 should "pop" outwardly and/or crack indicating that the tube has not been tampered with.

The squeeze tube of this invention is manufactured by methods well-known in the art, except that the frangible sealing member 36 across opening 32 of neck 30 is preferably molded with the dispensing head 26 in one extrusion or injection process. The tube of this invention is simple to manufacture, easy to use and provides a clear indication to the consumer whether the tube has been tampered with. The sealing member 36 can be easily and sanitarily removed and may be tested to determine whether the seal has maintained its integrity.

It should be pointed out that there can be substantial coaction between the cap for the tube and sealing member formed in the neck. As shown in FIGS. 3, 7 and 8, the inner surface of the cap supports and restrains the sealing member to prevent the sealing member from rupturing while the tube is being filled. This support provided by the cap enables the connection of the sealing member to the neck of the tube to be relatively thin and fragile, making it relatively easy to remove the sealing member without having to pierce the member drive portions of it back into the neck of the tube.

While specific embodiments of this invention are described and shown herein, it is to be understood that other embodiments may be resorted to without departing from the spirit and scope of the invention.

What is claimed is:

1. A tamper evident squeeze tube comprising:

a hollow elongated tube having flexible walls;

a sealing means at one end, which end is used for filling the tube prior to sealing;

a dispensing head at the other end comprising:

a neck having an opening therein to the interior of the tube; and a frangible sealing member mounted across the opening for sealing the opening and indicating tampering with the contents therein;

a cap adapted to be mounted to the exterior of the neck which cap includes a chamber for enclosing the sealing member when the cap is mounted to the neck and coating with the neck and sealing member to prevent the sealing member from fracturing while the tube is being filled, said sealing member being integral with the neck and being of a flexible dome shape, the interior of the cap including means for forcing the dome into the interior of the opening while the cap is being mounted to the neck and maintaining the dome therein while the tube is being filled.

2. The squeeze tube of claim 1, further comprising a tab means attached to the exterior of the dome for removing the sealing member.

3. The squeeze tube of claim 2, wherein the tab means is an elongated member projecting from the center of the dome.

4. The squeeze tube of claim 1, wherein the interior of the cap includes a planar surface which collapses the dome when the cap is mounted to the neck.

5. The squeeze tube of claim 1, wherein the means for forcing comprises:

a lip on the interior of the cap adapted to force the circumferential area of the dome into the interior of the opening without breaking the seal.

6. A tube cap for mounting to the neck of a squeeze tube, said neck having an opening therein to the interior of the tube and having a frangible sealing member mounted across the opening, said cap comprising:

a means for mounting the cap to the neck of the squeeze tube;

a chamber in the interior of the cap for enclosing the sealing member when the cap is mounted on the neck and coacting with the neck and the sealing member to prevent the sealing member from fracturing while the tube is being filled, the sealing member being dome shaped and the interior of the cap including a planar surface which collapses the sealing member when the cap is mounted to the neck, and the interior of the cap includes a means for forcing the sealing member into the interior of the opening of the neck while the cap is being mounted to the neck and maintaining the dome therein while the tube is being filled.

7. The tube cap of claim 6, wherein the means for forcing comprises:

a lip on the interior of the cap adapted to force the circumferential area of the dome into the interior of the opening without breaking the seal.

8. The tube cap of claim 6, wherein the dome shaped sealing member has an elongated tab means attached to the exterior of the dome for removing the sealing means and the means for forcing further comprises:

a planar surface adapted to force the elongated member projecting from the center of the dome into the interior of the opening to thereby force the dome into the interior of the opening.

* * * * *